US007982408B2

(12) United States Patent
Ribarich et al.

(10) Patent No.: US 7,982,408 B2
(45) Date of Patent: Jul. 19, 2011

(54) COLD-CATHODE FLUORESCENT LAMP (CCFL) CURRENT CONTROL CIRCUIT

(75) Inventors: Thomas J. Ribarich, Laguna Beach, CA (US); Daniel E. Goldberg, Thousand Oaks, CA (US)

(73) Assignee: International Rectifier Corporation, El Segundo, CA (US)

( * ) Notice: Subject to any disclaimer, the term of this patent is extended or adjusted under 35 U.S.C. 154(b) by 374 days.

(21) Appl. No.: 12/350,451

(22) Filed: Jan. 8, 2009

(65) Prior Publication Data

US 2009/0174341 A1 Jul. 9, 2009

Related U.S. Application Data

(60) Provisional application No. 61/019,671, filed on Jan. 8, 2008.

(51) Int. Cl.
*G05F 1/00* (2006.01)
*H05B 37/02* (2006.01)

(52) U.S. Cl. ..... 315/291; 315/307; 315/310; 315/311

(58) Field of Classification Search ..... 315/209 R, 315/224–225, 291, 307–308, 310–311
See application file for complete search history.

(56) References Cited

U.S. PATENT DOCUMENTS 6,420,839 B1 * 7/2002 Chiang et al. ..... 315/311
7,268,501 B1 * 9/2007 Chen ..... 315/291

* cited by examiner

*Primary Examiner* — Anh Q Tran
(74) *Attorney, Agent, or Firm* — Farjami & Farjami LLP

(57) ABSTRACT

A circuit to control an AC lamp current provided by an input AC voltage supply to a cold-cathode fluorescent lamp (CCFL). The circuit includes a capacitor connected in series between the AC voltage supply and one terminal of the CCFL, the capacitor biasing the CCFL with the AC lamp current; a switch having first, second, and control terminals, the first terminal being connected to the CCFL and the second terminal being connected to the other side of the supply; a diode connected in parallel to the switch; and a resistor connected in parallel to the diode, wherein the AC lamp current is controlled by controlling the switch to add and remove resistance in series with the CCFL.

11 Claims, 1 Drawing Sheet

COLD-CATHODE FLUORESCENT LAMP (CCFL) CURRENT CONTROL CIRCUIT

CROSS-REFERENCE TO RELATED APPLICATION

This application is based on and claims priority to U.S. Provisional Patent Application Ser. No. 61/019,671, filed on Jan. 8, 2008 and entitled NEW COLD-CATHODE FLUORESCENT LAMP (CCFL) CURRENT CONTROL CIRCUIT, the entire contents of which are hereby incorporated by reference.

BACKGROUND OF THE INVENTION

The present invention relates to controlling a cold-cathode fluorescent lamp, and more specifically, controlling the brightness of the cold-cathode fluorescent lamp to a specific level.

SUMMARY OF THE INVENTION

It is an object of the present invention to provide a means to control lamp current in the cold-cathode fluorescent lamp.

Provided is a circuit to control an AC lamp current provided by an input AC voltage supply to a cold-cathode fluorescent lamp (CCFL). The circuit includes a capacitor connected in series between the AC voltage supply and one terminal of the CCFL, the capacitor biasing the CCFL with the AC lamp current; a switch having first, second, and control terminals, the first and second terminals being connected in series with the CCFL and the AC voltage supply; a diode connected in parallel across the first and second terminals of the switch; and a resistor connected in parallel to the diode, wherein the AC lamp current is controlled by controlling the switch via the control terminal to add and remove resistance in series with the CCFL.

Other features and advantages of the present invention will become apparent from the following description of the invention that refers to the accompanying drawings.

DETAILED DESCRIPTION OF EMBODIMENTS OF THE INVENTION

Figure 1:
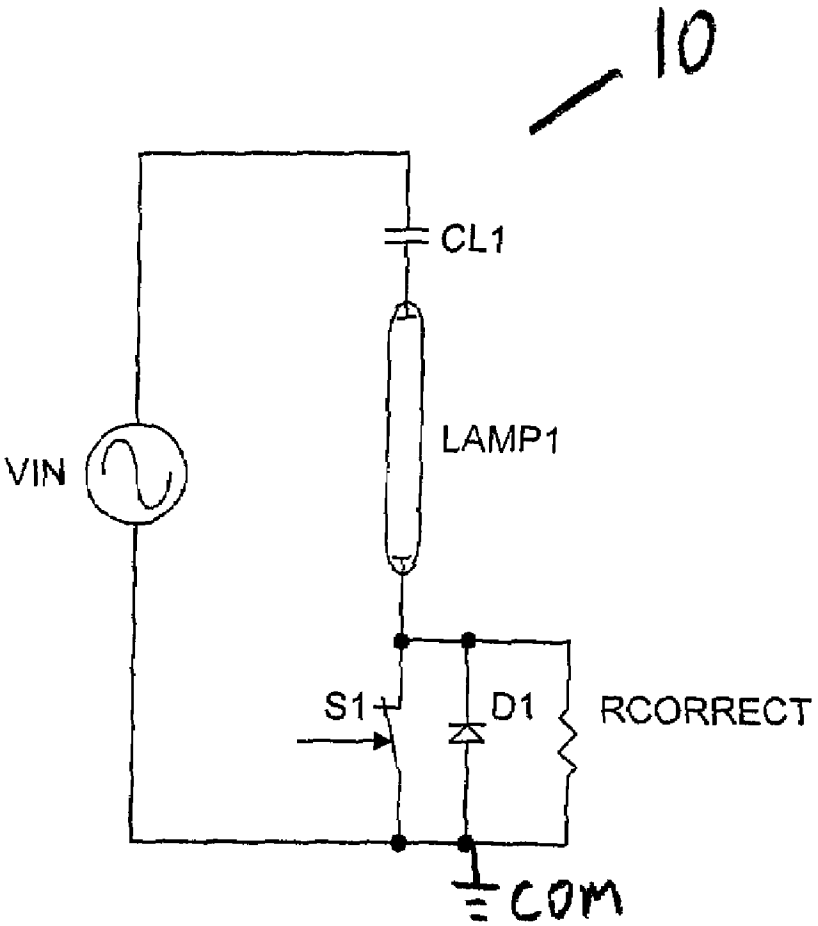
FIG. 1 is a circuit diagram of a cold-cathode fluorescent lamp (CCFL) current control circuit of a preferred embodiment of the present invention.

FIG. 1 illustrates a current control circuit 10 of a cold-cathode fluorescent lamp (CCFL) of the present invention. The current control circuit 10 includes a high-voltage input AC voltage supply VIN and a CCFL LAMP 1. A bias capacitor CL1 is connected in series between the AC voltage supply VIN and one terminal of the CCFL LAMP1, for biasing the CCFL LAMP1 with an AC lamp current. Another terminal of the CCFL LAMP1 is connected to a first terminal of a 3-terminal switch S1. The switch S1 may comprise a transistor, e.g., MOSFET, where one of the terminals is a control terminal. Known controller means may be used to control the switch on and off.

The circuit 10 further includes a correcting resistor RCORRECT and a free-flowing diode D1 both connected in parallel to or across the switch S1. The cathode of the diode D1 is connected to the first terminal of the switch S1 and the anode of the diode D1 is connected to the ground COM of the circuit 10.

Initially, the switch S1 is closed and the positive half-wave of the AC lamp current flows from the input AC voltage supply VIN, through the capacitor CL1, CCFL LAMP1, and the switch S1 to the ground, and back to the input AC voltage supply VIN. The negative half-wave of the AC lamp current flows from the ground COM, through the free-flowing diode D1 or the switch S1 or both, through the CCFL LAMP1, through the bias capacitor CL1, and to the AC input voltage supply VIN.

To correct or reduce the AC lamp current, the switch SI may be controlled to open thereby preventing the flow of the AC lamp current through the switch thereby forcing the AC lamp current to flow through the correction resistor RCORRECT instead of the switch S1. Typically, the resistance of the correction resistor RCORRECT is much greater than the on-resistance of the switch Si. Therefore, since the correction resistor RCORRECT introduces additional resistance in series with the lamp, the lamp current is reduced during the duration that the switch S1 is open. During this correction time, the AC lamp current is reduced and the instantaneous lamp power is also reduced. This causes the average lamp power to decrease and the lamp impedance to increase.

Because of the free-flowing diode D1, the correction resistor RCORRECT only reduces the AC lamp current during the positive half-wave of the AC lamp current. However, due to the ionization time-constant of the lamp, the lamp impedance remains higher for a given amount of time and therefore allows for the current to automatically be reduced by a similar amount during the negative half-wave of the AC lamp current cycle.

The correction is performed during the positive half-wave of a given AC lamp current cycle and the ionization time constant of the lamp LAMP1 gives a similar correction automatically during the negative half-wave. The switch S1 is closed again for the remainder of a given time period. The switch is then turned on and off continuously in fixed intervals to obtain the desired lamp current.

The correction could be performed during the negative half-cycle (as defined herein) by reversing the diode.

Although the present invention has been described in relation to particular embodiments thereof, many other variations and modifications and other uses will become apparent to those skilled in the art. It is preferred, therefore, that the present invention not be limited by the specific disclosure herein.

What is claimed is:

1. A circuit to control an AC lamp current provided by an input AC voltage supply to a cold-cathode fluorescent lamp (CCFL), the circuit comprising:

a capacitor connected in series between the AC voltage supply and one terminal of the CCFL, the capacitor biasing the CCFL with the AC lamp current;

a switch having first, second, and control terminals, the first and second terminals being connected in series with the CCFL and the AC voltage supply;

a diode connected in parallel across the first and second terminals of the switch; and a resistor connected in parallel to the diode, wherein the AC lamp current is controlled by controlling the switch via the control terminal to add and remove resistance in series with the CCFL.

2. The circuit of claim 1, wherein the switch is a MOSFET.

3. The circuit of claim 1, wherein the resistance of the resistor is greater than the on-resistance of the switch.

4. The circuit of claim 3, wherein when the switch is on the positive half-wave of the AC lamp current flows from the input AC voltage supply, through the capacitor, CCFL, and the switch to the input AC voltage supply, and the negative half-wave of the AC lamp current flows from the AC input voltage supply through the diode and the switch, the CCFL, and the capacitor to the AC input voltage supply.

5. The circuit of claim 1, wherein to control the AC lamp current the switch is turned off directing the AC lamp current flow through the resistor, thereby introducing additional resistance in series with the CCFL and reducing the AC lamp current.

6. The circuit of claim 5, wherein reduction of the AC lamp current reduces instantaneous lamp power, decreasing an average lamp power, and increasing the lamp impedance.

7. The circuit of claim 6, wherein the AC lamp current is controlled during the positive half-wave when the AC lamp current does not pass through the diode.

8. The circuit of claim 7, wherein during the negative half-wave when the AC lamp current passes through the diode the AC lamp current is not controlled, but due to the ionization time-constant of the CCFL the impedance of the CCFL remains higher for a first amount of time and therefore allows for the current to be automatically reduced during the negative half-wave.

9. The circuit of claim 1, wherein to obtain a desired AC lamp current the switch is continuously turned on and off in fixed intervals.

10. The circuit of claim 1, wherein a first correction of the AC lamp current is performed during the positive half-wave of the AC lamp current cycle and an ionization time constant of the CCFL automatically provides a second correction during the negative half-wave of the AC lamp current cycle.

11. The circuit of claim 1, further comprising a controller connected to the control terminal of the switch to control the switch on and off.

* * * * *